United States Patent [19]

Nihyakumen et al.

[11] 3,944,422

[45]*Mar. 16, 1976

[54] PHOTOSENSITIVE MATERIAL IN USE FOR DIAZO-TYPE MULTICOLOR REPRODUCTION

[75] Inventors: Kouzi Nihyakumen; Toshihiro Kouchi, both of Hirakata; Taizo Yokoyama, Osaka; Yasuo Ueda, Kobe; Yasutoki Kamezawa; Tatsuo Aizawa, both of Osaka, all of Japan

[73] Assignee: Mita Industrial Company Limited, Osaka, Japan

[ * ] Notice: The portion of the term of this patent subsequent to Feb. 6, 1990, has been disclaimed.

[22] Filed: Aug. 31, 1970

[21] Appl. No.: 68,516

[30] Foreign Application Priority Data

Sept. 1, 1969 Japan ..... 44-68937

[52] U.S. Cl. ..... 96/49; 96/91 R; 106/19; 250/318; 427/147; 427/148; 427/150; 427/151; 427/152; 427/261; 428/199; 428/207; 428/488

[51] Int. Cl.[2] ..... G03C 5/18; G03C 1/58

[58] Field of Search ..... 96/49, 75, 91; 117/36.7, 117/36.8, 36.9; 250/65 T

[56] References Cited

UNITED STATES PATENTS

| | | | |
|---|---|---|---|
| 2,416,773 | 3/1947 | Reichel | 96/91 R |
| 2,789,904 | 4/1957 | Benbrook et al. | 96/49 |
| 3,016,298 | 1/1962 | Sanders et al. | 96/91 R X |
| 3,316,092 | 4/1967 | Klimkowski et al. | 96/91 R |
| 3,326,686 | 6/1967 | Randall et al. | 96/91 R |
| 3,386,826 | 6/1968 | Aebi et al. | 96/91 R |
| 3,427,165 | 2/1969 | Champ et al. | 96/49 |
| 3,454,764 | 7/1969 | Collier et al. | 96/49 |
| 3,493,377 | 2/1970 | Rauhut et al. | 96/91 R |
| 3,520,692 | 7/1970 | Knoester et al. | 96/91 R |
| 3,529,964 | 9/1970 | Kienast et al. | 96/91 R |
| 3,653,903 | 4/1972 | Nihyakumen et al. | 96/91 R |

FOREIGN PATENTS OR APPLICATIONS

| | | | |
|---|---|---|---|
| 1,000,151 | 8/1965 | United Kingdom | 96/49 |

OTHER PUBLICATIONS

Landau, R., "Journal of Photo Sci", Vol. 13, 1965, pp. 144–151.

Kosar, J., "Light-Sensitive Systems", 1965, pp. 234 and 240.

*Primary Examiner*—Charles L. Bowers, Jr.

*Attorney, Agent, or Firm*—Sherman & Shalloway

[57] ABSTRACT

An improved process for diazo-type multicolor reproduction comprising

A. exposing to light an assembly comprising i. an original comprising opaque image areas and complementary non-image areas which transmit light, ii. a photosensitive layer containing at least one photosensitive diazonium salt (c), an azo coupler (b) and a substantially non-thermovolatile acidic substance (d), the acidic substance (d) being present in an amount of at least 5 mols per mol of the diazonium salt (c), and iii. a layer of a thermovolatile or sublimable coupler (a) disposed between the original and the photosensitive layer in face-to-face contact with the photosensitive layer in areas corresponding to only a selected portion of the total image areas of the original, the coupler (a) having a higher coupling rate under developing conditions than the coupler (b), and a dyestuff formed from the coupler (a) and the diazonium salt (c), and a dyestuff formed from the coupler (b) and the diazonium salt (c) having hues different from one another, to form latent image areas on the photosensitive layer corresponding to the image areas of the original;

B. heating the assembly to thereby transfer the coupler (a) onto the surface of the photosensitive layer, steps (A) and (B) being carried out coincidentally, or in the order of (A) to (B), or (B) to (A); and C. thereafter developing the exposed photosensitive layer whereby a multicolor reproduction is obtained in which image areas of one color correspond with areas where the coupler (a) has coupled with the diazonium salt (c), and in which image areas of another color correspond with the remaining image areas where the coupler (b) has coupled with the diazonium salt (c).

18 Claims, No Drawings

PHOTOSENSITIVE MATERIAL IN USE FOR DIAZO-TYPE MULTICOLOR REPRODUCTION

This invention relates to a diazo-type multicolor reproduction process, which allows one to obtain multicolored copies in which portions corresponding to predetermined portions of an original are colored selectively in different hues without substantial mingling of colors.

A process has been previously proposed for diazo-type multicolor reproduction based on the discovery that predetermined portions of an original can be reproduced into different hues regardless of difference or similarity of the light transmission in the original by conducting the steps of (A) exposing to light a diazo-type photosensitive material containing at least one diazonium salt (c) and (B) heating a layer of at least one thermovolatile or thermosublimative coupler (a) disposed in face-to-face contact with the diazo-type photosensitive material at a portion corresponding to a predetermined portion of an original, the steps being carried out coincidentally or in an order of (A) to (B) or (B) to (A), and then developing the exposed photosensitive material in the presence of a coupler (b) having a lower coupling rate under developing conditions than the thermovolatile or thermosublimative coupler (a).

When the above process is conducted by employing a commercially available, diazo-type photosensitive material, at portions corresponding to predetermined portions of an original, an azo dyestuff can be obtained having a different hue from that of a dyestuff formed at other portions, but it has been found that at such portions corresponding to the predetermined portions of the original there is also formed the dyestuff of the same kind as that formed at other portions and mingling of colors is caused to occur, which renders the color contrast indistinct.

Further, in the above process, when the coupler (a) is heated and transferred to the diazo-type photosensitive material, the photosensitive material also undergoes the heating to a great extent, and the coupler (a) once heat transferred to the photosensitive material is caused to thermally volatilize from the photosensitive layer of the photosensitive material by excessive heat, resulting in indistinct coloration after the development and an extreme decrease of the number of multicolored copies obtained by one treatment.

With a view to developing a diazo-type multicolor photosensitive material free of the above-mentioned defects, further research has been conducted and it has now found that the coupling rate of a coupler (b) having a lower coupling rate with the diazonium salt (c) contained in the photosensitive material than that of the coupler (a) to be heat transferred to the photosensitive material can be effectively controlled and stabilized by using a substantially non-thermovolatile acidic substance in a great excess as compared with the amount usually contained in a conventional diazo-type photosensitive material, and that use of such photosensitive material containing a substantially non-thermovolatile acidic substance in great excess makes it possible to obtain a practically suitable number of multicolored copies, e.g., 40 – 50 copies, by one treatment. It has been also found that preferable results are obtained by using a substantially non-thermovolatile acidic substance in an amount of at least 5 moles, particularly 8 – 15 moles, per mole of the diazonium salt used in the photosensitive material. Still further, it has been found that when coupler (a) to be heat transferred to the photosensitive material is a compound having an amino group and is capable of forming an acid addition salt, such compound transferred from the back surface of the original reacts with the substantially non-thermovolatile acidic substance present in great excess in the photosensitive material to form a non-thermovolatile acid addition salt and even when the heating is effected by excessive heat (80° – 100°C.), the coupler (a) converted to the acid addition salt cannot volatilize or escape, with the result that a large number, e.g. 40 – 50, of multicolored copies excellent in color can be obtained by one treatment.

Based on the above findings, this invention has been developed. Thus, in accordance with this invention a diazo-type multicolor reproduction is provided which comprises the use of a diazonium salt and a substantially non-thermovolatile acidic substance, such acidic substance being present in an amount of at least 5 moles per mole of the diazonium salt.

Still further, in accordance with this invention a process is provided for diazo-type multicolor reproduction which comprises conducting the steps of (A) exposing to light a diazo-type photosensitive material containing a diazonium salt (c) and a substantially non-thermovolatile acidic substance, such acidic substance being present in an amount of at least 5 moles per mole of the diazonium salt (c), and (B) heating a layer of at least one thermovolatile or thermosublimative coupler (a) disposed in face-to-face contact with the diazo-type photosensitive material at a portion corresponding to a predetermined portion at an original, said steps (A) and (B) being carried out coincidentally or in an order of (A) to (B) or (B) to (A), and then developing the photosensitive material in the presence of a coupler (b) having a lower coupling rate under developing conditions than the thermovolatile or thermosublimative coupler (b).

As the substantially non-thermovolatile acidic substance to be used in this invention, citric acid, tartaric acid, boric acid, sulfamic acid, salicylic acid, phosphoric acid, sodium primary phosphate, oxalic acid, acidic sodium sulfate, succinic acid, malic acid, butyric acid, maleic acid, phthalic acid, lactic acid, propionic acid, aluminum sulfate, trimellitic acid and alunite can be cited.

Any coupler that has a lower rate of coupling with the diazonium salt (c) contained in the photosensitive material than that of the thermovolatile or thermosublimative coupler (a) under the same developing conditions can be used as coupler (b) in this invention. Typical examples of such coupler are as follows:

Phenol Derivatives 2,5,6-Trimethylphenol
2-Hydroxymethylphenol
β-(2-hydroxyphenyl)-propionic acid
2-(ω-Phenylaminomethyl)-phenol
β-(4-Methyl-2-hydroxyphenyl)-glutaric acid
2,5-Dimethyl-6-(N-dimethylaminomethyl)-phenol
1,3-Dimethyl ether of pyrogallol
α-Resorcylic acid ethanolamine
β-Resorcyclic acid
N-Lauryl-p-aminophenol
N-Acyl-m-aminophenol
Meta-hydroxy-acetoanilide Ortho-N-hydroxyphenyl-monoguanidine
Para-N-hydroxyphenyl-biguanidine
2,5-Dimethyl-4-morpholinomethyl phenol
2-Methyl-5-isopropyl-morpholinomethyl phenol
4-Morpholinomethylresorcinol monomethyl ether
3,3',5-Trihydroxydiphenyl
3,3',5,5'-Tetrahydroxydiphenyl
2,2',4,4'-Tetrahydroxydiphenyl
2,4,4'-Trihydroxydiphenyl-2'-sulfonic acid
2,4,6,3',5'-Pentahydroxydiphenyl
2,2',4,4'-Tetrahydroxydiphenyl sulfide Naphthols 2,3-Dihydroxynaphthalene-6-sulfonic acid
2Naphthol3,6-disulfonic acid
2,7-Dihydroxynaphthalene-3-sulfonic acid
2,8-Dihydroxynaphthalene-6-sulfonic acid
1,8-Dihydroxynaphthalene-8-sulfonic acid
1,8-Aminonaphthol-5-sulfonic acid
2,7-Dihydroxy-3,6-disulfonic acid
1,8-Benzoylaminonaphthol-2-sulfonic acid
1,8-Dihydroxynaphthalene-6-sulfonic acid
2-Hydroxy-3-naphthionic-N-β-hydroxyethyl amine
β-Hydroxynaphthionic acid aminoethylamine
2-Hydroxy-3-naphthionic-N,N-bis-β-hydroxyl ether amide
8-Hydroxy-2-naphthionic-hydroxyethyl amide
1-(N-Carboethoxymethylamino)8-naphthol-4-sulfonic acid
5-(Para-nitro)-benzamido-1-naphthol
1-Hydroxynaphthyl-7-phenyl-guanidine
2-Hydroxynaphthyl-8-biguanidine
1-Naphthol-3-(N-β-hydroxyethyl)-sulfonic amide
1-Naphthol-3-(N-o-methoxyphenyl)-sulfonic amide
Bis-[5-hydroxy-7-sulfo-naphthyl(2)]-amine
N,N-Bis[1-hydroxy-3-sulfo-naphthyl(6)]-thiourea Active Methylene Group-Containing Compounds Acetoacetic acid cyclohexylamide
Acetoacetic acid benzylamide
Cyanoacetoanilide
Cyanoacetomorpholine Heterocyclic Compounds 1-(3'-Sulfoamide)-phenyl-3-methylpyrazolone-5
1 -(4'-Carboxy-ethylphenyl)-3-dodecyl-pyrazolone-5
8-Hydroxy-1,2-naphthylimidazole
2-Methyl-4-hydroxybenzimidazole
7-Methyl-4-hydroxybenzothiazole
1,7-Dimethyl-4-hydroxy-benzotriazole
3-Hydroxythiophene-5-carboxylic acid
1-3-4-Cyclopentatrione Any conventional diazonium salt used in a diazo-type photosensitive material may be used as the diazonium salt (c) in this invention, as long as it is capable of coupling with the coupler (a) at a relatively high coupling rate under ordinary developing conditions and coupling with the coupler (b) at a relatively low coupling rate under ordinary developing conditions. Typical examples of such diazonium salt are as follows:

Para-phenylene-diamine-N,N-substituted compounds of the following general formula:

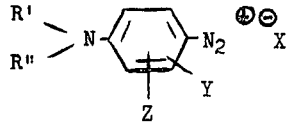

wherein X stands for an anion R' and R'' each are aliphatic groups, and Z and Y denote groups which can be introduced into the benzene nucleus.

Specific examples of the compounds of this type are as follows:

4-Diazo-N,N-dimethyl aniline
(referred to simply as "MA salt")
4-Diazo-N,N-diethyl aniline
(referred to simply as "EA salt")
4-Diazol-N-ethyl-N-β-hydroxyethyl aniline
(referred to simply as "EH salt")
4-Diazo-N,N-bis-β-hydroxyethyl aniline
4-Diazo-N-methyl-N-β-hydroxyethyl aniline
4-Diazo-N-ethyl-N-β-hydroxypropyl aniline Other diazonium salts of p-phenylene diamines N,N-substituted with alkyl or hydroxy-alkyl groups
4-Diazo-N-(β-diethylamino)-ethyl aniline
4-Diazo-2-chloro-N,N-diethyl aniline
4-Diazo-2-methyl-N,N-diethyl aniline
4-Diazo-2-iodo-N,N-diethyl aniline
4-Diazo-2-trifluoromethyl-N,N-diethyl aniline
4-Diazo-N-ethyl-N-benzyl aniline
4-Diazo-N-methyl-N-benzyl aniline (referred to simply as "methyl benzyl")

Aminohydroquinone ether-type compounds of the following general formula:

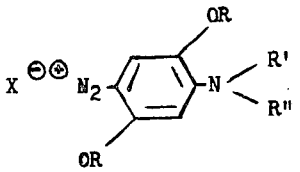

wherein R,R' and R'' are alkyl or aryl groups and X stands for an anion.

Specific examples of the compounds of the above type are as follows:

4-Diazo-2,5-dibutoxy-N,N-diethyl aniline
4-Diazo-2,5-diethoxy-N-benzoyl aniline
(referred to simply as "BB salt")
4-Diazo-2,5-diethoxy-N-ethyl-N-benzoyl aniline
4-Diazo-2,5-dibenzyloxy-N-benzoyl aniline
4-Diazo-2-chloro-5-methoxy-N-benzoyl aniline
4-Diazo-2,5-diethoxy-N-benzoyl-methyl aniline
4-Diazo-2,5-diethoxy-N-benzoyloxy-methyl aniline
Other 4-diazo-2,5-dioxyalkyl (or dioxyaryl)-N-alkyl (or aryl) compounds and derivatives thereof Aminodiphenyl compounds, aminodiphenyl amine compounds and their analogues of the following general formulas:

$$X^{-+}N_2—R—A—R'$$

and $$X_2^{-+}N—R—A—R'^{+-}X$$

wherein X is an anion, R is a divalent aryl group, R' is a monovalent or divalent aryl or alkyl group, A is a divalent group or a direct bond and examples of the R—A—R' are diarylamine (A; —NH—), diphenyl (A;

direct bond), diphenyl oxide (A; —O—), diaryl methane (A; $—CH_2—$), stilbene (A; —CH=CH—) and diaryl or dialkyl sulfide (A; —S—).

Specific examples of the compounds of the above type are as follows:

Para-diazophenyl amine
4-Diazo-2,5,4′-triethoxydiphenyl amine
4-Diazo-2,5,4′-triethoxydiphenyl
4,4′-Bis-diazo-2,2′,5,5′-tetrahydroxydiphenyl methane
Bis-diazo-8,8′-dichloro-5,5′-dimethoxy benzidine
4-Diazo-2,5-dimethoxyphenylethyl sulfide
4-Diazo-2,5-diethoxy-4′-methyl-diphenyl sulfide Heterocyclic amine derivatives of the following general formula:

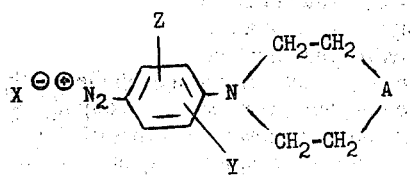

wherein X stands for an anion, Y and Z are groups which can be introduced into the benzene nucleus, and A is a direct bond (phenyl pyrrolidine) or a divalent group such as —O— (morpholine), —S— (thiomorpholine) and methylene (phenylpiperidine).

Specific examples of the compounds of this type are as follows:

4-Diazo-2,5-dibutoxy-N-phenyl morpholine
4-Diazo-2,5-diethoxy-N-phenyl morpholine
4-Diazo-2-methoxy-N-thio morpholine
4-Diazo-N-phenyl piperidine
4-Diazo-N-phenyl pyrrolidine
4-Diazo-2,5-di-n-butoxy-N-phenyl piperidine
Other derivatives of 4-Diazo-N-phenyl heterocyclic amines.

N,N-Substituted ortho-phenylene diamine derivatives and orthoamino-phenol derivatives.

Specific examples of the compounds of this type are as follows:

2-Diazo-4-methylmercapto-N,N′-dimethyl aniline
2-Diazo-5-benzoylamino-N,N′-dimethyl aniline
2-Diazo-1-naphthol-5-sulfonic acid The above-mentioned diazonium compounds may be used in the form of a relatively stable salt with sulfuric acid or hydrochloric acid. They may be also used in the form of a double salt with zinc chloride, tin chloride, aluminum sulfate or the like. Further, they may be used when stabilized by an aryl sulfonate (in the form of a diazonium salt of an aromatic sulfonic acid), a diazosulfonate or the like. These diazonium salts may be used either singly or in the form of a mixture of two or more of them.

In this invention, sensitizing compositions formed from the diazonium salt (c) and coupler (b) together with optional assistants selected depending on the developing method are coated on a substrate such as paper, plastic film, textile fabric, non-woven fabric and metal foil to form the photosensitive material. The preparation of such photosensitive material will now be described by referring to some examples of the same.

A. Sensitizing composition for dry development :

| | |
|---|---|
| Diazo compound (c) | 0.2 – 5.0 % |
| Azo coupling component (b) | 0.2 – 5.0 % |
| Acidic substance | 5 – 15 moles per mole of the diazo compound (c) |
| Coloring matter | 0.001 – 0.025 % |
| Development promotor | 1.0 – 10.0 % |
| Extender | 0 – 2.5 % |
| Solvent | balance |

The sensitizing composition of the above recipe is coated on a substrate such as paper or plastic film, and dried to form a photosensitive sheet.

B. Two-component-type sensitizing composition for wet development :

| | |
|---|---|
| Diazo compound (c) | 0.2 – 5.0 % |
| Azo coupling component (b) | 0.2 – 5.0 % |
| Acidic substance | 5 – 15 moles per mole of the diazo compound (c) |
| Extender | 0 – 2.5 % |
| Stabilizer | 0 – 5.0 % |
| Coloring matter | 0.001 – 0.025 % |
| Solvent | balance |

The sensitizing composition of the above recipe is coated on a substrate such as paper or plastic film, and dried to form a photosensitive sheet.

C. One-component-type sensitizing composition for wet development :

| | |
|---|---|
| Diazo compound (c) | 0.2 – 5.0 % |
| Acidic substance | 5 – 15 moles per mole of the diazo compound (c) |
| Extender | 0 – 2.5 % |
| Coloring matter | 0.001 – 0.025 % |
| Solvent | balance |

The sensitizing composition of the above recipe is coated on a substrate such as paper and dried to form a photosensitive sheet.

In the above compositions, as the acidic substance, the above-recited substantially non-thermovolatile acidic substances such as citric acid, tartaric acid, oxalic acid and sulfamic acid may be used. As the extender, dextrin, gum arabic, colloidal silica, etc. may be used. As the stabilizers, 1,3,6-naphthalene, sodium trisulfonate and other aryl sulfonic acids may be used. Polyhydric alcohols such as glycerin and ethylene glycol are used as development promoter. Coloring matters are used for indicating the photosensitive face and increasing the whiteness of the back ground, and blue dyestuffs such as Methylene Blue and Patent Blue are used for this purpose. As the solvent, water and organic solvent such as alcohols, acetone, toluene, xylene and esters may be used.

The multicolor reproduction using the diazo-type photosensitive materials of this invention is performed by conducting the steps of (A) exposing to light a photosensitive material containing at least one diazonium salt (c) and a substantially non-thermovolatile acidic substance in the above-mentioned amount and (B) heating a layer of at least one thermovolatile or thermosublimative coupler (a) disposed in face-to-face contact with such photosensitive material at a predetermined portion, the steps being carried out coincidentally or in an order of (A) to (B) or (B) to (A), and then subjecting the exposed photosensitive material under developing conditions in the presence of a coupler (b) having a lower rate of coupling with the diazonium salt (c) than that of the thermovolatile or thermosublimative coupler (a).

It is essential that between thermovolatile or thermosublimative coupler (a), coupler (b) and diazonium salt (c) used in this invention, the following relations be established:

I. Thermovolatile or thermosublimative coupler (a) has a higher coupling rate under developing conditions than coupler (b).

II. Dyestuff (b)-(c), dyestuff (a)-(c), dyestuff (a')-(c) . . . formed by development have hues different from one another.

Any coupler that can be volatilized or sublimated under heating conditions may be used as thermovolatile or thermosublimative coupler (a) in this invention. As such coupler (a), phenol derivatives, hydroxynaphthalene derivatives, aniline derivatives and active methylene group-containing compounds may be used. In view of the desire to facilitate the heat transfer operation it is preferred that these derivatives do not contain soluble groups such as a sulfonic acid group.

Examples of these derivatives usable as coupler (a) are as follows:

Phenol Derivatives

Phenol
Pyrocatechol
Resorcin
phloroglucinol
o-Hydroxybenzalcohol
Resorcin monoglycol ether
Resorcin diglycol ether
Hydrotoluquinone
Pyrogallol-4-carboxylic acid
Vanillin
Isovanillic acid
Vanillic acid
5-Hydroxy-isophthalic acid
2-Hydroxy-terephthalic acid
2-Hydroxy-p-toluylic acid
3-Hydroxy-p-toluylic acid
5-Hydroxy-o-toluylic acid
6-Hydroxy-m-toluylic acid
5-Hydroxy-1-naphthonic acid
Para-hydroxyphenylacetic acid
2,7-Dihydroxynaphthalene
2,3-Dihydroxynaphthalene
8-Amino-2-naphthol
2,2'-dihydroxy-1,1'-binaphthyl
4,4'-dihydroxy-1,1'-binaphthyl
3-Carboxy-2-naphthol Aniline Derivatives Meta-aminobenzoic acid
2-Amino-p-cresol
Ortho-aminophenol
Para-aminophenol
Para-chloroaniline
3,4-Diaminotoluene Active Methylene Group-Containing Compounds 1-Phenyl-3-methylpyrazolone (5)
1-Phenyl-3-carboxypyrazolone
Acetoacetic acid anilide
Acetoacetic-o-chloroanilide
Para-hydroxybenzaldehyde
Ortho-hydroxybenzoic acid
Ortho-hydroxybenzyl alcohol
4,4-Dihydroxybiphenol
3,5-Dichloro-salicylic acid
5-Chloro-2-nitrophenol
2,5-Dihydroxyacetophenone
2,5-Dinitrophenol
2,4-Dinitrophenol
2,4-Dinitroresorcin
4,6-Dibromo-2-nitrophenol
2,5-Dimethyl hydroquinone Hydroxynaphthalene Derivatives 2,3-Dihydroxynaphthalene
β-Naphthol
α-Naphthol
1,6-Dihydroxynaphthalene
2,6-Dihydroxynaphthalene
2,7-Dihydroxynaphthalene When a plurality of thermovolatile or thermosublimative couplers (a) is used, the coupling rate of coupler (b) should be lower than that of any of couplers (a). Selection of couplers (a) and (b) meeting the above requirement may be easily performed by those skilled in the art based on a simple experiment.

In conducting the reproduction process of this invention, first an original for multicolor development is formed by applying at least one transparent or semi-transparent layer of a thermovolatile or thermosublimative coupler (a) onto the back surface of one or more predetermined portions of a transparent or semi-transparent original to be copied.

The so formed original for multicolor development is overlapped on the diazo-type photosensitive material of this invention in a manner such that the layer of coupler (a) will confront the photosensitive surface of the photosensitive material, and the light-exposure and heating are effected coincidentally or successively in this order or the reverse order. Thus, the thermovolatile or thermosublimative coupler (a) is heat-transferred to the surface of the predetermined portion of the photosensitive material, and the light resolution of the diazonium salt (c) in the photosensitive material occurs depending on the light transmission of the original. When the so exposed photosenstive material is developed by a method known per se, at the predetermined portion to which the coupler (a) has been heat-transferred, the diazonium salt (c) at the non-exposed area reacts selectively and preferentially with the coupler (a) to form a dyestuff (c) - (a) and at other portion the diazonium salt (c) at the non-exposed area reacts with coupler (b) to form a dyestuff (c) - (b). Thus, a multicolored reproductive copy is obtained in which the predetermined portion is colored in a hue different from that of the other portion.

The above-mentioned original for multicolor development may be prepared, for instance, by a method comprising applying a coating composition containing the above-mentioned thermovolatile or thermosublimative coupler (a) onto the back surface of a portion predetermined to have a different hue, of a transparent or semi-transparent original to be copied, or by a method comprising coating or impregnating a transparent or semi-transparent substrate with the coating composition and combining the resulting sheet for heat-transferring the coupler, with the back surface of the specific portion of the original predetermined to have a different hue in a manner such that the layer for heat-transferring the coupler will confront the photosensitive material.

A coating composition for treating the back surface of an original and forming a layer for heat-transferring the coupler can be easily prepared by dispersing a coupler (a) into a liquid, semi-solid or solid dispersion medium.

Such treating agent will now be described by referring to some embodiments.

(1) Ink-like composition for treating the back surface of an original :

| | |
|---|---|
| Coupler (a) | 5.0 – 25.0 % |
| Coloring material | 0 – 3.0 % |
| Binder | 0 – 5.0 % |
| Dispersion assistant | 0 – 2.0 % |
| Dispersion medium | balance |

As the dispersion medium, water and organic solvents such as alcohol, toluene, xylene, esters and methyl ethyl ketone may be used. It is possible to incorporate a coloring material so as to confirm the formation of a film of the treating agent, or to use a binder for the purpose of obtaining a good fixation of the coupler.

The composition of the above recipe is applied to the back surface of a portion predetermined to have a different hue by means of a brush, an installed felt pen, a ball pen, a coating roller, a sprayer or a printing machine.

(2) Waxy composition for treating the back surface of an original :

| | |
|---|---|
| Coupler (a) | 5.0 – 25.0 % |
| Wax | 85.0 – 15.0 % |
| Oil | 10.0 – 40.0 % |
| Coloring material | 0 – 20.0 % |

The composition of the above recipe is shaped to have a crayon stick-like form or a chalk-like form, and the back surface of a portion of an original predetermined to have a different hue is painted therewith. It is also possible to form a pressure-sensitive transfer sheet by melting the above composition or dissolving it in a suitable solvent and coating the melt or solution on a substrate such as paper and plastic film. The so formed pressure-sensitive transfer sheet is overlapped on the back surface of an original sheet, and then pressing is effected thereon by means of a typewriter or other writing means to form a heat-transferable layer on the back surface of an image predetermined to have a different hue.

3. Coupler-transferring sheet for treating the back surface or an original:

The ink-like composition for treating the back surface of an original, which was described in (1), or a composition obtained by incorporating a binder on an extender into such ink-like composition is coated on a transparent or semi-transparent sheet such as paper, plastic film or non-woven fabric. The so formed sheet for heat-transferring the coupler is cut into a desired size, if necessary, and then applied to the back surface of a portion of an original predetermined to have a different hue. It is possible to form a pressure-sensitive adhesive layer on the back surface of the coupler-transferring layer for preventing it from exfoliating from the original.

The so prepared original for multicolor development may be generally used 30 to 120 times repeatedly for the multicolor development, though the applicable frequency of the repeated use varies depending on the amount of coupler (a) coated, the coating method, the heating method and the developing method. Of course, when the heat-transferability of coupler (a) in the layer for heat-transferring the coupler is lowered, it is sufficient to supply newly an additional layer for heat-transferring the coupler.

The exposure of the photosensitive material and the transfer of the thermovolatile or thermosublimative coupler (a) to the photosensitive surface may be effected coincidentally. For instance, in case a mercury lamp is used as the light source for exposure, the heat transfer of the coupler (a) may be effected coincidentally with the exposure by the heat conveyed through a cylinder glass of the light source maintained at a relatively high temperature. Of course, the heat transfer of the coupler (a) may be also effected by the radiation heating of an image of the original. The heat transfer of the coupler (a) may be effectively performed by heating the layer for heat-transferring the coupler at a temperature above 50°C., preferably above 70°C., though a preferable heating temperature varies to some extent depending on the kind of coupler (a) used and the heating time. It is also possible to adopt a method comprising piling the above-mentioned original for multicolor development and the photosensitive material, passing the assembly through a heated roller or an infrared radiation zone to heat the layer for heat-transferring the coupler at the above-mentioned temperature and to effect the heat transfer of the coupler, and then passing the same through an exposure zone to effect the exposure of the photosensitive material.

It is also possible to adopt a method in which the exposure and heat transfer are conducted in an order reverse to that of the above method, namely a method comprising piling the original for multicolor development and the photosensitive material, passing the assembly through an exposure zone to effect the exposure of the photosensitive material and then passing the same through a heating zone to effect the heat transfer of the coupler (a).

In accordance with this invention, the photosensitive material which has been exposed to light and on a predetermined portion of which the coupler (a) has been heat-transferred, is developed by means known per se. The development may be conducted by either a dry method or a wet method.

In accordance with the dry process, the development may be performed sufficiently by exposing the light-exposed photosensitive material to a mixture of ammonia and steam. In the case of the wet process the development can be accomplished by contacting the photosensitive material with an aqueous liquid developer containing an alkali.

In the case of the wet developing, the light exposed photosensitive sheet is contacted with a one-component-type alkaline liquid developer containing the coupler (b) by a customary coating method such as the direct coating method, the roll coating method and the spray coating method. An example of the alkaline liquid developer is a composition having the following recipe:

One-component-type liquid developer for the wet development :

| | |
|---|---|
| Coupler (b) | 0.2 – 1.5 % |
| Alkaline agent | 0.5 – 20 % |
| Reducing agent | 0 – 20 % |
| Surfactant | 0 – 0.5 % |

-continued

One-component-type liquid developer for the wet development :

| | |
|---|---|
| Water | balance |

In accordance with this invention, by making the substantially non-thermovolatile acidic substance present in the photosensitive material in an amount of at least 5 moles per mole of the diazonium salt contained in the photosensitive material, the coupling rate of the coupler (b) present in the photosensitive material or liquid developer, with the diazonium salt (c) in the photosensitive material can be stably lowered and, accordingly, it is possible to color the portion corresponding to the predetermined portion of original selectively in a different hue without any trouble of mingling of colors. In short, when the diazo-type multicolor reproduction is conducted according to this invention, it is possible to obtain multicolored copies excellent in color distinction and color contrast with high image density by conducting a simple development procedure.

Further, according to this invention, a good fixation of the thermovolatile or thermosublimative coupler to the photosensitive layer can be attained and the efficiency of heat transfer of the thermovolatile or thermosublimative coupler to the photosensitive layer can be highly improved. Accordingly, it is possible to obtain a great many multicolored copies from one treated original.

This invention will now be detailed by referring to examples.

EXAMPLES OF THE PREPARATION OF INK-LIKE COMPOSITIONS

Example A

An ink-like composition of the following recipe is prepared as a yellow color-forming agent for treating the back surface of an original:

| | |
|---|---|
| Acetoacetic anilide | 20 g |
| Glycerin | 15 g |
| Alkyd resin | 5 g |
| Methanol | 100 ml |

The above composition is directly used as a material to be coated on the back surface of a portion of the original desired to be reproduced in yellow by means of a brush, a coating roller or a sprayer, or after it has been charged in a felt pen or a ball pen, it is used as a material for treating the back surface of a portion of the original desired to be reproduced in yellow.

Example B

An ink-like composition of the following recipe is prepared as a red color-forming agent for treating the back surface of an original:

| | |
|---|---|
| 1-Phenyl-3-methylpyrazolone (5) | 20 g |
| Styrene resin | 5 g |
| Glycerin | 15 g |
| Ethanol | 100 ml |

The above composition is directly used as a material to be coated on the back surface of a portion of the original to be reproduced in red by means of a brush, a coating roller or a sprayer, or after it has been charged in a felt pen or a ball pen, it is used as a material for treating the back surface of a portion of the original to be reproduced in red.

Example C

An ink-like composition of the following recipe is prepared as a brown color-forming agent for treating the back surface of an original:

| | |
|---|---|
| Resorcin | 20 g |
| Vinyl acetate resin | 5 g |
| Glycerin | 15 g |
| Methanol | 100 ml |

The above composition is directly used as a material to be coated on the back surface of a portion of the original desired to be reproduced in brown by means of a brush, a coating roller or a sprayer, or after it has been charged in a felt pen or a ball pen, it is used as a material for treating the back surface of a portion of the original desired to be reproduced in brown.

Example D

A blue-violet color-forming agent is prepared by using 2,3-dihydroxynaphthalene instead of acetoacetic anilide in the composition of Example A.

EXAMPLES OF THE PREPARATION OF WAXY COMPOSITIONS

Example E

A waxy composition to be used as a yellow color-forming agent for treating the back surface of an original is prepared by heat melting

| | |
|---|---|
| Acetoacetic anilide | 30 g |
| Stearic acid | 100 g |
| Paraffin | 50 g |
| Terra abla | 50 g |
| Diatomaceous earth | 20 g |

and solidifying the melt.

Te above composition is molded into a crayon stick-like form and is used as a material to be coated on the back way, of a portion of the original desired to be reproduced into a different hue.

Example F

A waxy composition to be used as a yellowish brown colorforming agent for treating the back surface of an original is prepared by heat melting

| | |
|---|---|
| Resorcin monoglycol ether | 20 g |
| Paraffin | 50 g |
| Terra abla | 70 g |
| Haze wax | 20 g |
| Stearic acid | 100 g |
| Magnesium carbonate | 20 g |

and solidifying the melt.

The so formed composition is molded into a crayon stick-like or chalk-like form and is used as a material for coating the back surface of a portion of an original desired to be reproduced in a different hue.

Example G

A waxy composition of the following recipe is prepared as a red color-forming agent for treating the back surface of an original:

| | |
|---|---|
| 1-Phenyl-3-methylpyrazolone (5) | 20 g |
| Stearic acid | 100 g |
| Paraffin | 50 g |
| Diatomaceous earth | 30 g |
| Haze wax | 20 g |

The above composition is molded into a crayon stick-like or chalk-like form and is used as a material for coating the back surface of a portion of the original desired to be reproduced in a different hue.

Example H

To the composition of Example G, 100 g of mineral oil, 50 g of oleic acid and 20 g of Permanent Red are added, and the mixture is kneaded in a bowl mill to disperse additional components uniformly. Then, the kneaded mixture is coated on a substrate such as paper to obtain a pressure-sensitive copy sheet. The so formed copy sheet is overlapped on the back surface of an original and the pressing is effected thereon by means of a typewriter or other writing means. The sheet is used as a material for forming a layer of the waxy agent on the back surface of an image of the original to be reproduced in a different hue.

EXAMPLES OF THE PREPARATION OF COUPLER-TRANSFERRING SHEETS:

Example I

A composition of the following recipe is prepared as a yellow color-forming agent for treating the back surface of an original:

| | |
|---|---|
| Acetoacetic acid aniline | 20 g |
| Triacetate resin | 10 g |
| Methanol | 30 ml |
| Acetone | 70 ml |

The above composition is coated on a transparent or semitransparent sheet such as polyester film by means of a rod coater and dried at a relatively low temperature (40° – 50°C.) to form a sheet for heat-transferring the coupler. After being cut into a desired size according to need, the sheet is used as a material to be applied to the back surface of a portion of an original desired to be reproduced in a different hue.

Example J

A composition to be used as a red color-forming agent for treating the back surface of an original is prepared by using 1-phenyl-3-methylpyrazolone (5) instead of acetoacetic acid aniline in Example I. From this composition, a sheet is formed for heat-transferring the coupler capable of forming a red color.

Example K

A composition to be used as a blue color-forming agent for treating the back surface of an original is prepared by using 2,3-dihydroxynaphthalene instead of acetoacetic acid aniline in Example I. From this composition, a heat-transferable sheet capable of forming a blue color is formed.

EXAMPLE 1

Multicolor-forming diazo-type photosensitive paper in use for wet development

A solution of the following recipe is prepared:

| | |
|---|---|
| 4-Diazo-2,5-diethoxy-N-benzoylaniline.½$ZnCl_2$ | 15 g |
| Citric acid | 80 g |
| Dextrin | 20 g |
| Methylene Blue | 0.1 g |
| Water | balance |
| Total | 1 liter |

The so formed solution is coated on a base paper of a photosensitive sheet by a customary coating method such as the method using an air knife coater, and dried. The so formed photosensitive sheet is superposed on an original, the back surface of a predetermined portion of which is treated with the waxy composition prepared in Example G, in a manner such that the photosensitive layer of the photosensitive sheet confronts the treated surface of the original. Then the assembly is heated and light exposed by means of a mercury lamp and developed with a liquid developer of the following recipe:

| | |
|---|---|
| NW acid | 20 g |
| Potassium carbonate | 80 g |
| Sodium bicarbonate | 30 g |
| Sodium thiosulfate | 60 g |
| Borax | 10 g |
| Water | balance |
| Total | 1 liter |

by a customary developing method using a roller or sprayer. In this way. a two-color copy is obtained in which the portion corresponding to the portion of the original treated with the composition of Example G is colored in red and the portion corresponding to the untreated portion of the original is colored in bluish violet. The copy is excellent in color distinction without mingling of colors.

EXAMPLE 2

Multicolor-forming diazo-type photosensitive paper in use for dry development

A solution of the following recipe is prepared:

| | |
|---|---|
| 4-Diazo-N,N-dimethyl-aniline chloride.½$ZnCl_2$ | 15 g |
| Diethylene glycol | 60 g |
| Citric acid | 100 g |
| 2,7-Dihydroxynaphthalene-3,6-disulfonic acid sodium salt | 20 g |
| Zinc chloride | 50 g |
| Thiourea | 25 g |
| Patent Pure Blue | 0.1 g |
| Water | balance |
| Total | 1 liter |

The solution is coated on a base paper by a customary coating procedure such as using an air knife coater and dried to from a photosensitive sheet.

The sheet is overlapped on an original in which the back surface of a portion is treated with the ink-like composition prepared in Example A and the back surface of another portion is treated with the treating composition prepared in Example B. Then, the assembly is heated at 70° – 100°C. and exposed to light by means of a mercury lamp to form a latent image of the diazonium salt.

Next, the so treated sheet is subjected to development with gasified ammonia and steam. A clear three-color copy is obtained in which the portion corresponding to the portion treated with the composition of Example A is colored in a yellow color, the portion corresponding to the portion treated with the composition of Example B is colored in red and the other portion corresponding to the untreated portion is colored in blue.

EXAMPLE 3

When Example 2 is repeated by using 4-diazo-N-ethyl-N-hydroxyethyl-aniline chloride.½$ZnCl_2$ instead of 4-diazo-N,N-dimethylanile chloride.½$ZnCl_2$, a multicolor reproductive copy similar to that of Example 2 is obtained

EXAMPLE 4

Multicolor-forming photosensitive paper in use for dry development

A solution of the following recipe is prepared:

| | |
|---|---|
| 4-Diazo-N,N-diethylaniline chloride.½$ZnCl_2$ | 15 g |
| Glycerine | 50 g |
| Tartaric acid | 100 g |
| 2-Hydroxy-3,6-disulfonic acid | 30 g |
| Zinc chloride | 25 g |
| Thiourea | 25 g |
| Patent Blue | 0.1 g |
| Water | balance |
| Total | 1 liter |

By a customary coating method such as using an air knife coater, a photosensitive paper is prepared from the above solution. The photosensitive paper is overlapped on an original in which a portion of the back surface is treated with the waxy composition prepared in Example E and another portion of the back surface is treated with the composition prepared in Example G. The assembly is exposed to light and heated by means of a mercury lamp. Then, the so treated sheet is subjected to development with gasified ammonia and steam. A clear three-color reproductive copy is obtained in which the portion corresponding to the portion of the original treated with the composition of Example E is colored in yellow, the portion corresponding to the portion treated with the composition of Example G is colored in red, and the other portion corresponding to the untreated portion of the original is colored in bluish violet.

EXAMPLE 5

Multicolor-forming photosensitive paper for dry development

A solution of the following recipe is prepared:

| | |
|---|---|
| 4-Diazo-N,N-dimethylaniline chloride.½$ZnCl_2$ | 20 g |
| Diethylene glycol | 50 g |
| Citric acid | 110 g |
| 2,7-Dihydroxynaphthalene-3,6-disulfonic acid sodium salt | 20 g |
| Resorcinol monomethyl ether | 13 g |
| Zinc chloride | 10 g |
| Thiourea | 50 g |
| 1,3,6-Naphthalene-trisulfonic acid sodium salt | 20 g |
| Patent Blue | 0.1 g |
| Water | balance |
| Total | 1 liter |

Frm the above solution a photosensitive paper is prepared in the same manner as in Example 1. The so formed photosensitive sheet is piled on an original, in which the back surface of a portion is treated with the coupler-heat-transferring sheet prepared in Example J and the back surface of another portion is treated with the coupler-heat-transferring sheet prepared in Example K. Then the assembly is heated and light-exposed by means of a mercury lamp, and the photosenitive sheet is developed with gaseous ammonia and steam. A clear three-color copy excellent in color distinction is obtained, in which the portion corresponding to the portion of the original treated with the coloring sheet prepared in Example J is colored in red, the portion corresponding to the portion of the original treated with the coloring sheet prepared in Example K is colored in blue, and the other portion is colored in black. The copy is free of any mingling of colors.

EXAMPLE 6

Multicolor-forming photosensitive paper for dry development

A solution of the following recipe is prepared:

| | |
|---|---|
| 4-Diazo-N,N-dimethylaniline chloride | 20 g |
| Ethylene glycol | 50 g |
| Citric acid | 100 g |
| Boric acid | 20 g |
| 2,4,2',4'-Tetrahydroxydiphenyl sulfide | 15 g |
| Thiourea | 25 g |
| Zinc chloride | 50 g |
| Patent Blue | 0.1 g |
| Water | balance |
| Total | 1 liter |

The above solution is coated on a semi-transparent paper such as tracing paper and dried to form a photosensitive paper. The photosensitive paper is piled on an original, a portion of the back surface of which is treated with the ink-like composition prepared in Example B and another portion of the back surface of which is treated with the composition obtained in Example D. Then the assembly is heated and printed by means of a mercury lamp, followed by development with gaseous ammonia and steam. A clear three-color reproductive copy usable as the intermediate is obtained in which the portion corresponding to the portion of the original treated with the composition of Example B is colored in red, another portion corresponding to the portion treated with the composition of Example D is colored in blue and another portion corresponding to the untreated portion of the original is colored in yellowish brown. The so formed intermediate is excellent in color distinction and free of mingling of colors.

EXAMPLE 7

Multi-color-forming photosensitive paper for dry development

A solution of the following recipe is prepared:

| | |
|---|---|
| 4-Diazo-N-ethyl-N-hydroxyethylaniline chloride.½$ZnCl_2$ | 20 g |
| Diethylene glycol | 75 g |
| Oxalic acid | 50 g |
| Tartaric acid | 50 g |
| α-Resorcylic acid ethanol amine | 20 g |
| Zinc chloride | 50 g |
| Thiourea | 25 g |
| Patent Blue | 0.1 g |
| Water | balance |
| Total | 1 liter |

By a customary coating method such as using an air knife coater, the above solution is applied to a substrate of a photosensitive paper and dried. The so formed photosensitive paper is piled on an original, a portion of the back surface of which is treated with a coupler-heat-transferring sheet prepared in Example K, and the assembly is heated and printed by means of a mercury lamp, followed by development with gaseous ammonia and steam. A clear two-color reproductive copy is obtained without any substantial mingling of colors, in which the portion corresponding to the portion of the original treated with the sheet obtained in Example K is colored in blue and the remaining portion corresponding to the untreated portion of the original is colored in red.

EXAMPLE 8

Multicolor-forming photosensitive paper for dry development

A solution of the following recipe is prepared:

| | |
|---|---|
| 4-Diazo-N,N-diethylaniline chloride.½$ZnCl_2$ | 20 g |
| Diethylene glycol | 50 g |
| Citric acid | 80 g |
| Bis-[5-hydroxy-7-sulfonaphthyl(2)]-amine | 25 g |
| Zinc chloride | 30 g |
| Thiourea | 25 g |
| Hydrochloric acid (36%) | 10 ml |
| Patent Blue | 0.1 g |
| Water | balance |
| Total | 1 liter |

The above solution is applied to a photosensitive paper substrate by a customary coating method such as using an air knife coater, and the resulting photosensitive paper is piled on an original, a portion of the back surface of which is treated with the ink-like composition obtained in Example C. The assembly is heated and printed by means of a mercury lamp, followed by development with gaseous ammonia and steam. A clear two-color reproductive copy is obtained in which a portion corresponding to the treated portion of the original is colored in brown and other remaining portion corresponding to the untreated portion of the original is colored in dark blue. The copy is excellent in color distinction and free of mingling of colors.

EXAMPLE 9

Multicolor-forming sensitive paper in use for either dry or wet development

A solution of the following recipe is prepared:

| | |
|---|---|
| 4-Diazo-2,5-dibutoxy-N-phenymorpholine.½$ZnCl_2$ | 15 g |
| Citric acid | 110 g |
| Diethylene glycol | 40 g |
| β-Hydroxynaphthonic acid aminoethyl amine (hydrochloride) | 20 g |
| Thiourea | 40 g |
| Zinc chloride | 30 g |
| Patent Blue | 0.1 g |
| Water | balance |
| Total | 1 liter |

From the above solution, a photosensitive paper is prepared by conducting the coating and drying in the same manner as in Example 1. The so formed photosensitive paper is piled on an original, a portion of the back surface of which is treated with the ink-like composition prepared in Example A and another portion of the back surface of which is treated with the treating material prepared in Example C. Then the assembly is heated and printed by means of a mercury lamp, followed by development with gaseous ammonia and steam or with an alkaline liquid developer of the following recipe:

| | |
|---|---|
| Potassium carbonate | 30 g |
| Sodium thiosulfate | 40 g |

-continued

| | |
|---|---|
| Sodium bicarbonate | 30 g |
| Potassium tetraborate | 5 g |
| Water | balance |
| Total | 1 liter |

A clear three-color reproductive copy is obtained without any substantial mingling of colors, in which the portion corresponding to the portion of the original treated with the composition of Example A is colored in yellow, the portion corresponding to the portion of the original treated with the composition of Example C is colored in brown and the remaining portion corresponding to the untreated portion of the original is colored in blue.

EXAMPLE 10

Multicolor-forming film

A solution of the following recipe is prepared:

| | |
|---|---|
| 4-Diazo-2,5-dibutoxy-N-phenylmorpholine.½$ZnCl_2$ | 15 g |
| Citric acid | 60 g |
| β-Hydroxynaphthonic acid ethanol amine | 20 g |
| Triacetate resin | 15 g |
| Oil Blue | 0.2 g |
| Acetone | 600 ml |
| Methanol | 400 ml |

ink-like

The solution is coated on a polyester film by a rod coater and dried at a relatively low temperature (40°–50°C.) by warm air to form a photosensitive film. The film is piled on an original in which a part of the back surface of an original image is treated with the inklike composition prepared in Example A and another part of the back surface of the original image is treated with the treating composition prepared in Example B. The assembly is exposed to light by a mercury lamp and heated. The photosensitive film containing a latent image of the diazonium salt is developed with gasified ammonia and steam. A clear three-color reproductive copy is obtained without any substantial mingling of colors, in which the portion corresponding to the part treated with the treating composition of Example A is colored in yellow, the portion corresponding to the part treated with the treating composition of Example B is colored in red, and the other portion corresponding to the untreated part of the original is colored in blue.

COMPARATIVE EXAMPLE

This example is given to illustrate the relation between the amount of the substantially non-thermovolatile acidic substance in the photosensitive material and the number of copies obtainable by one treatment of the original.

Experimental procedures

The photosensitive liquid of the following recipe is prepared:

| | |
|---|---|
| 4-Diazo-N,N-dimethylaniline chloride.½$ZnCl_2$ (MA salt) | 15 g |
| Diethylene glycol | 50 g |
| Citric acid | variable |
| 2,7-Dihydroxynaphthalene-3,6-disulfonic acid sodium salt | 20 g |
| Zinc chloride | 20 g |
| Thiourea | 50 g |
| Water | balance |
| Total | 1 liter |

The above solution is coated on a substrate of a photosensitive sheet by a customary coating method such as using an air knife coater, followed by drying. The so formed photosensitive paper is piled on an original, a part of the back surface of the image of which is treated with a 20% ethanol solution of meta-aminophenol and another part of the back surface of the image of which is treated with a 20% ethanol solution of 1-phenyl-3-methyl-pyrazolone (5). The piling is conducted in a manner such that the treated surface of the original confronts the photosensitive layer of the photosensitive sheet. Then the assembly is light-exposed and heated at 80°C. for 3 seconds by mean of a mercury lamp, followed by the development with gasified ammonia and steam. The amount of citric acid is varied as indicated in Table 1 below.

Table 1

| Sample No. | Moles of MA salt | Moles of citric acid |
|---|---|---|
| 1 | 1 | 3 |
| 2 | 1 | 4 |
| 3 | 1 | 5 |
| 4 | 1 | 6 |
| 5 | 1 | 6 |
| 5 | 1 | 7 |
| 6 | 1 | 8 |
| 7 | 1 | 9 |
| 8 | 1 | 10 |
| 9 | 1 | 11 |
| 10 | 1 | 12 |

With respect to each sample, the number of copies in which colors can be clearly distinguished by naked eye observation is counted. The results are shown in Table 2 below.

Table 2

| Sample No. | Portion treated with ethanol solution of meta-aminophenol | Portion treated with ethanol solution of 1-phenyl-3-methyl-pyrazolone (5) |
|---|---|---|
| 1 | 3 | 4 |
| 2 | 6 | 7 |
| 3 | 10 | 11 |
| 4 | 16 | 21 |
| 5 | 41 | 47 |
| 6 | 47 | 50 |
| 7 | 65 | 80 |
| 8 | 82 | 95 |
| 9 | 96 | 115 |
| 10 | 103 | 122 |

From the results shown in Table 2, it can be seen that when citric acid, the substantially non-thermovolatile acidic substance, is used in an amount of at least 5 moles per mole of the diazonium salt, the number of multicolored copies obtainable by one treatment of the original reaches 40 or more, which is a number usually required in practical multicolor reproduction.

What we claim is:

1. A process for multi-color reproduction, which comprises:

A. exposing image-wise to actinic light a diazotype photosensitive material by exposing through an original sheet of an assembly consisting of (1) an original sheet having opaque image areas and transparent or semi-transparent non-image areas on one surface and a layer containing at least one thermovolatile or sublimable azo coupler (a), coupler (a) being located in only preselected areas which are contiguous with opaque image areas of said original sheet, said preselected areas being present in only a portion of the areas contiguous with said opaque image areas of said original sheet, and (ii) a diazo-type photosensitive material having a photosensitive layer containing at least one photosensitive diazonium salt (c), a substantially non-thermovolatile acidic stabilizer (d) being present in an amount of at least 5 moles per mole of the diazonium salt (c) and an azo coupler (b) having a substantially lower rate of coupling with the diazonium salt (c) under the developing conditions than that of the azo coupler (a), said original sheet (i) being superposed on said diazo-type photosensitive material (ii) so that the layer of the azo coupler (a) comes into face-to-face contact with the photosensitive layer;

B. heating said assembly to thereby heat-transfer said layer of the coupler (a) to the corresponding position on the surface of said photosensitive layer, said steps (A) and (B) being performed simultaneously or in the time sequence of (A) to (B) or (B) to (A); and C. contacting the exposed photosensitive material with a mixture of ammonia and steam or an alkali-containing aqueous liquid developer to thereby develop said photosensitive material, whereby in the unexposed latent image area of the portion to which the coupler (a) has been heat-transferred, a dye (c)-(a) having a certain hue or color is formed by the selective reaction of the heat-transferred coupler (a) with the diazonium salt (c) and at the same time, in the unexposed latent image areas to which the coupler (a) has not been heat-transferred a dye (c)-(b) having a different hue or color from said dye (c)-(a) is formed by the reaction of the coupler (b) with the diazonium salt (c), thus producing a multi-colored copied image.

2. The process of claim 1 wherein said substantially non-thermovolatile acidic substance (d) is present in the photosensitive layer in an amount of 8–15 mols per mol of said diazonium salt (c).

3. The process of claim 1 wherein said substantially non-thermovolatile acidic substance (d) is selected from the group consisting of citric acid, tartaric acid, boric acid, sulfamic acid, salicyclic acid, phosphoric acid, sodium primary phosphate, oxalic acid, acidic sodium sulfate, succinic acid, malic acid, butyric acid, maleic acid, phthalic acid, lactic acid, propionic acid, aluminum sulfate, trimellitic acid and alunite.

4. The process of claim 1 wherein said thermovolatile or sublimable coupler (a) is a compound having an amino group and capable of forming a non-volatile acid addition salt with said substantially non-thermovolatile acidic substance (d).

5. The process of claim 1 wherein said coupler (a) is applied to the back surface of said original (i).

6. The process of claim 1 wherein said layer containing coupler (a) is formed by coating on a surface of the original a composition comprising from 5–25% by weight of said coupler (a), 0–3% by weight of a colorant, 0.5% by weight of a binder and 0–2% by weight of a dispersant, the balance being an organic solvent with subsequent drying of the coating.

7. The process of claim 1 wherein said coupler (a) is applied in the form of a composition comprising 5–25% by weight of the coupler (a), 85–15% by weight of a wax, 10–40% by weight of an oil and 0–20% by weight of a colorant.

8. The process of claim 1 wherein said coupler (a) is on a transparent transfer sheet disposed between said original (i) and said photosensitive layer (ii).

9. The process of claim 1 wherein said coupler (a) is a compound free of sulfonic acid groups and selected from a phenol compound, a hydroxynaphthalene compound, an aniline compound and a compound containing an active methylene group.

10. A process for multi-color reproduction, which comprises:

A. exposing image-wise to actinic light a diazotype photosensitive material by exposing through an original sheet of an assembly consisting of (i) an original sheet having opaque image areas and transparent non-image areas on one surface and a layer containing at least one thermovolatile or sublimable azo coupler (a), coupler (a) being located in only preselected areas which are contiguous with opaque image areas of said original sheet, said preselected areas being present in only a portion of the areas contiguous with said opaque image areas of said original sheet, and (ii) a diazo-type photosensitive material having a photosensitive layer containing at least one photosensitive diazonium salt (c) and a substantially non-thermovolatile acidic substance (d) being present in an amount of at least 5 moles per mole of the diazonium salt (c), said original sheet (i) being superposed on said diazo-type photosensitive material (ii) so that the layer of the azo coupler (a) comes into face-to-face contact with the photosensitive layer, B. heating said assembly to thereby heat-transfer said layer of the coupler (a) to the corresponding position on the surface of said photosensitive layer, said steps (A) and (B) being performed simultaneously or in the time sequence of (A) to (B) or (B) to (A); and C. thereafter developing the exposed photosensitive layer with an alkaline aqueous liquid developer containing a coupler (b), wherein said coupler (a) has a higher coupling rate under developing conditions than said coupler (b), whereby in the unexposed latent image area of the portion to which the coupler (a) has been heat-transferred, a dye (c)-(a) having a certain hue or color is formed by the selective reaction of the heat-transferred coupler (a) with the diazonium salt (c) and at the same time, in the unexposed latent image areas to which the coupler (a) has not been heat-transferred, a dye (c)-(b) having a different hue or color from said dye (c)-(a) is formed by the reaction of the coupler (b) with the diazonium salt (c), thus producing a multicolored copied image.

11. The process of claim 10 wherein said substantially non-thermovolatile acidic substance (d) is present in the photosensitive layer in an amount of 8–15 mols per mol of the diazonium salt (c).

12. The process of claim 10 wherein said substantially non-thermovolatile acidic substance (c) is selected from the group consisting of citric acid, tartaric acid, boric acid, sulfamic acid, salicylic acid, phosphoric acid, sodium primary phosphate, oxalic acid, acidic sodium sulfate, succinic acid, malic acid, butyric acid, maleic acid, phthalic acid, lactic acid, propionic acid, aluminum sulfate, trimellitic acid and alunite.

13. The process of claim 10 wherein said thermovolatile or sublimable coupler (a) is a compound having an amino group and is capable of forming a non-volatile acid addition salt with said substantially non-thermovolatile acidic substance (d).

14. The process of claim 10 wherein said coupler (a) is applied to the back surface of the original (i).

15. The process of claim 10 wherein said layer containing coupler (a) is formed by coating a surface of the original with a composition comprising from 5–25% by weight of the coupler (a), 0–3% by weight of a colorant, 0–5% of a binder and 0–2% by weight of a dispersant, the balance being an organic solvent with subsequent drying of the coating.

16. The process of claim 10 wherein said coupler (a) is applied in the form of a composition comprising from 5–25% by weight of the coupler (a), 85–15% by weight of a wax, 10–40% by weight of an oil and 0–20% by weight of a colorant.

17. The process of claim 10 wherein said coupler (a) is on a transparent transfer sheet disposed between said original (i) and said photosensitive layer (ii).

18. The process of claim 10 wherein said coupler (a) is a compound free of sulfonic acid groups and selected from a phenol compound, a hydroxynaphthalene compound, an aniline compound and a compound containing an active methylene group.

* * * * *